US009359115B1

(12) United States Patent
Niggel

(10) Patent No.: US 9,359,115 B1
(45) Date of Patent: Jun. 7, 2016

(54) PUSH PULL CONTAINER CLOSURE

(71) Applicant: Berlin Packaging, LLC, Chicago, IL (US)

(72) Inventor: Brett Niggel, St. Corry, PA (US)

(73) Assignee: Berlin Packaging, LLC, Chicago, IL (US)

( * ) Notice: Subject to any disclaimer, the term of this patent is extended or adjusted under 35 U.S.C. 154(b) by 35 days.

(21) Appl. No.: 14/549,618

(22) Filed: Nov. 21, 2014

(51) Int. Cl.
*B65D 47/26* (2006.01)
*B65D 47/24* (2006.01)

(52) U.S. Cl.
CPC ..... *B65D 47/243* (2013.01)

(58) Field of Classification Search
CPC ..... B65D 47/243; B65D 47/061
USPC ..... 222/525
See application file for complete search history.

(56) References Cited

U.S. PATENT DOCUMENTS 3,372,833 A * 3/1968 Baraune ..... B65D 47/242 220/288
4,020,981 A * 5/1977 Nixdorff ..... B65D 47/243 222/48
5,975,369 A * 11/1999 Yurkewicz ..... B65D 41/32 215/251
6,513,681 B2 * 2/2003 Gross ..... B05B 11/0029 222/211
6,932,248 B2 * 8/2005 Fracasso ..... B65D 47/28 222/522
6,959,840 B2 * 11/2005 Iwatsubo ..... B05B 11/047 222/130
8,474,665 B2 * 7/2013 Arvizu ..... B65D 47/243 215/311

FOREIGN PATENT DOCUMENTS

DE 4121249 A1 * 1/1993 ..... B65D 47/243
FR EP 0378488 A1 * 7/1990 ..... B65D 47/242

* cited by examiner

*Primary Examiner* — Nicholas J Weiss
(74) *Attorney, Agent, or Firm* — Adam K. Sacharoff; Much Shelist

(57) ABSTRACT

In one embodiment there is provided a push-pull closure having a shell and a cap movable in relation to the shell to an opened and closed position. The shell includes an annual body surrounding a central opening in fluid communication with the container opening and further includes a stem suspended within the central opening and connected to the annual body by radial ribs. The cap includes an inner skirt extending from a pouring edge and having a lower section configured to cooperate and seal against the stem, against an outside radial rib surface, and against an inside surface of the annual body when the cap is in the closed position.

15 Claims, 8 Drawing Sheets

PUSH PULL CONTAINER CLOSURE

FIELD OF THE INVENTION

The present invention relates to a closure to a container or bottle and more particularly to a push-pull container closure.

BACKGROUND OF THE INVENTION

Many containers, particularly bottles containing dispensing fluids have closures or caps which are twisted or pulled to open a passage for dispensing the liquid, and provide a seal to close the container and prevent leaking when not in use. There is a continual need to improve upon the prior art and develop other technologies to provide a push-pull container closure. One of which is provided by the present invention.

SUMMARY OF THE INVENTION

In one embodiment of the present invention there is provided a push-pull closure having a shell and a cap. The shell includes a cylindrical wall interiorly configured to attach on one end to a container opening. The shell also includes an annual body surrounding a central opening in fluid communication with the container opening when attached thereto. A stem is suspended within the central opening. The stem has having radial ribs extending from the annual body to a top portion of the stem to define a generally cylindrical fluid path between an inner surface of the annual body and the stem. The radial ribs include an outside radial rib surface tapering downwardly and outwardly from the stem to the annual body. The cap has a pouring edge and includes the below defined skirts. First, an outer skirt extending from the pouring edge wherein a portion of the outer skirt rides exteriorly against a section of the cylindrical wall. Second, a middle skirt extending from the pouring edge and being interior to the outer skirt, and wherein a portion of the middle skirt rides against an outside surface of the annual body. Finally, an inner skirt extending from the pouring edge and being interior to the middle skirt, the inner skirt terminating at an inner skirt end, the inner skirt further having a lower section positioned about the inner skirt end, and wherein the lower section is configured to cooperate and seal against the stem, against the outside radial rib surface, and against the inside surface of the annual body when the cap is in the closed position.

In other embodiments, the shell further includes an inner thread adapted to mate with a container. Alternatively, the radial ribs may comprise four ribs equally spaced around the central opening.

In yet other embodiments, the shell may include a cylindrical wall defining (a) a lower portion that extends downwardly from a lower ledge, (b) a mid-portion extending from the lower ledge to a mid-ledge, and further defining (c) the annual body extending from the mid-ledge to an upper terminal edge. From this embodiment, the outer skirt may terminate at an outer skirt end and wherein a portion of the outer skirt rides against the mid-portion of the cylindrical wall with the outer skirt end making contact with the lower ledge when the cap is in a closed position. Similarly, the middle skirt may terminate at a middle skirt end, and wherein a portion of the middle skirt rides against an outside surface of the annual body with the middle skirt end making contact with the mid-ledge when the cap is in a closed position. In addition, a portion of the inner skirt may ride against an inside surface of the annual body.

In other embodiment, the inner skirt may extend downwardly from the pouring edge and radially inwardly slightly to a first position and then extend downwardly from the first position to the lower section. The lower section may taper radially outwardly to the inner skirt end to define the lower section profile. The lower section profile may be configured to cooperate and seal against the stem, against the outside radial rib surface, and against the inside surface of the annual body when the cap is in the closed position.

Yet in still other embodiments, an inside surface of the middle skirt may comprise an inwardly extending lip, where an outside surface of the annual body may comprise an outwardly extending lip. The inwardly extending lip and outwardly extending lip can cooperate to retain the cap on the shell when the cap is extending in a fully opened position.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
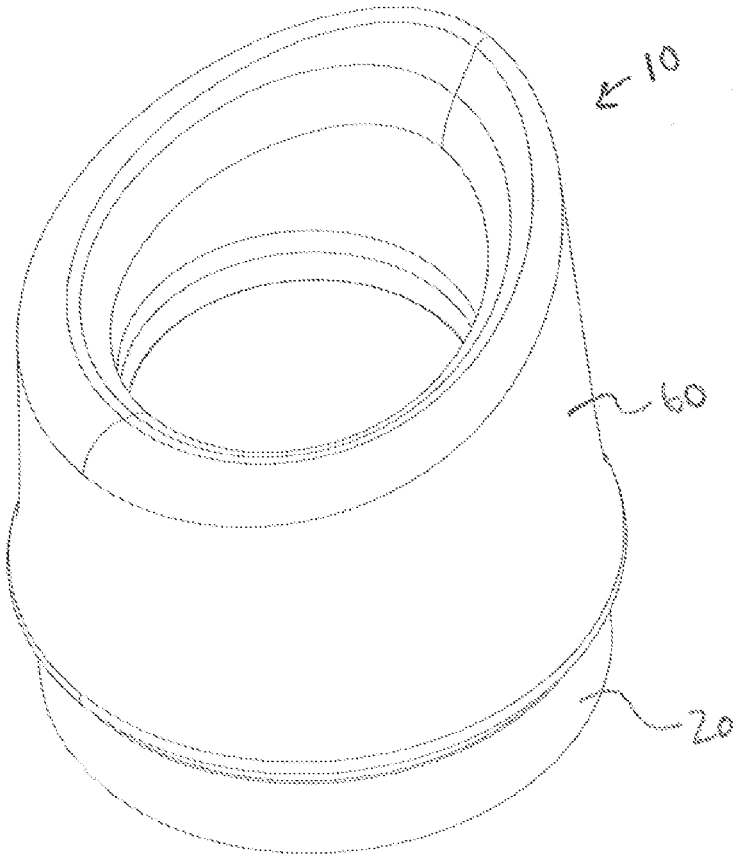
FIG. 1 is a perspective view of a closure in accordance with an embodiment of the present invention and being illustrated in a closed position.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
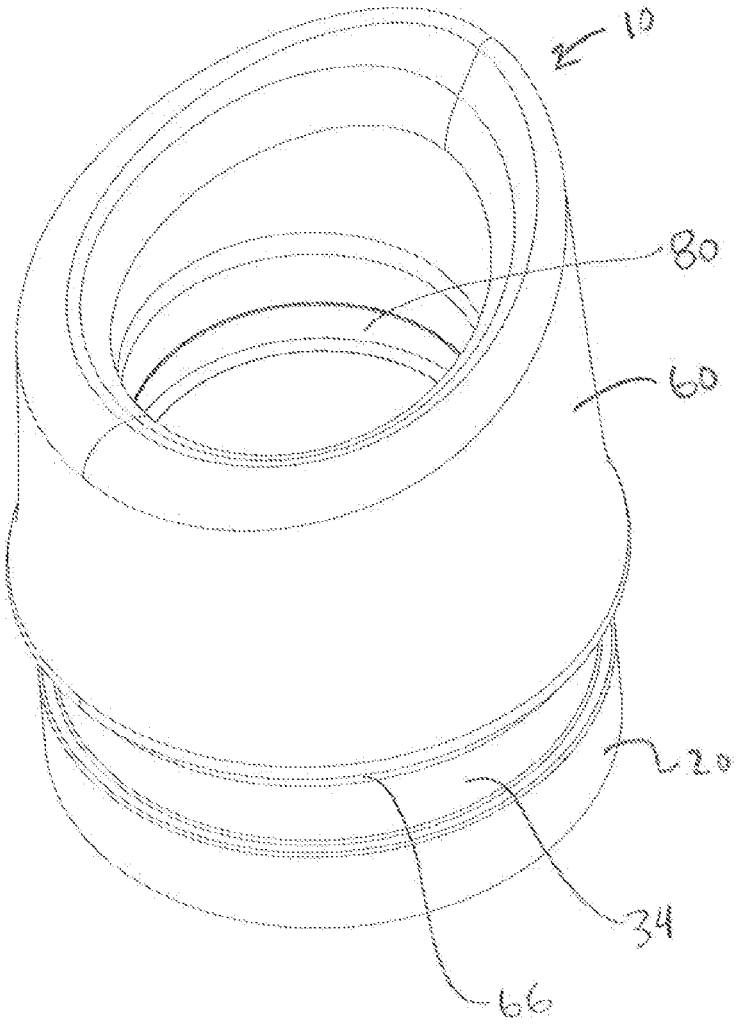
FIG. 2 is a perspective view of a closure in accordance with an embodiment of the present invention and being illustrated in an opened position.
Figure 3:
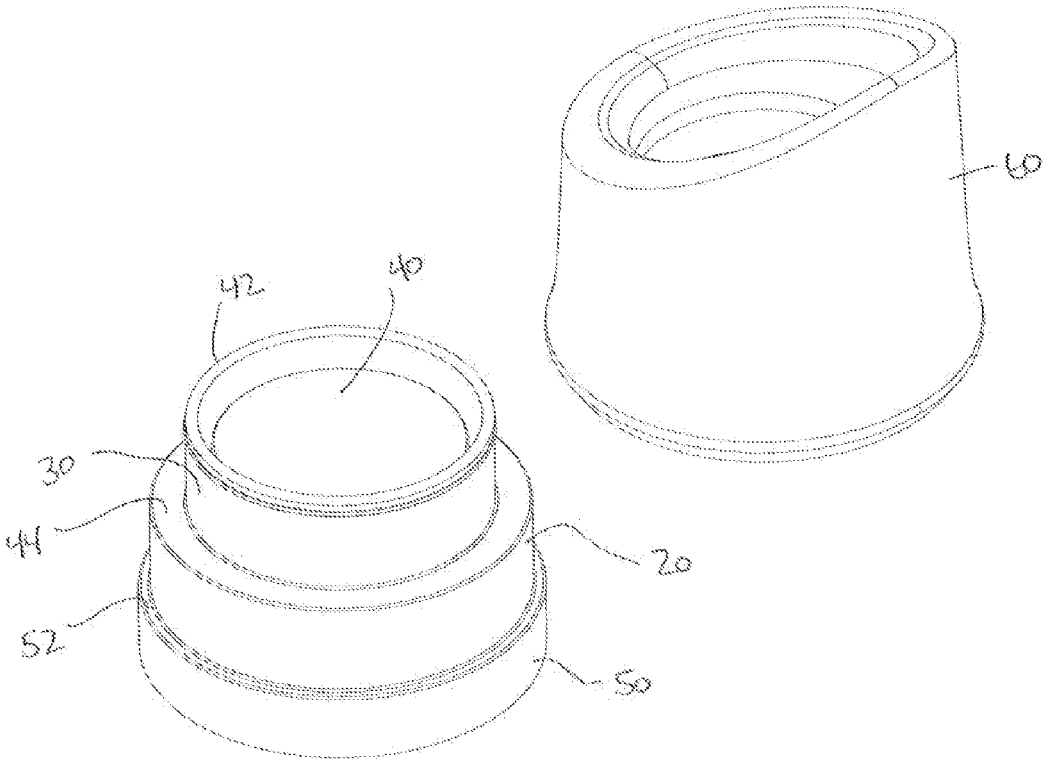
FIG. 3 is an exploded view of a closure in accordance with an embodiment of the present invention.
Figure 4:
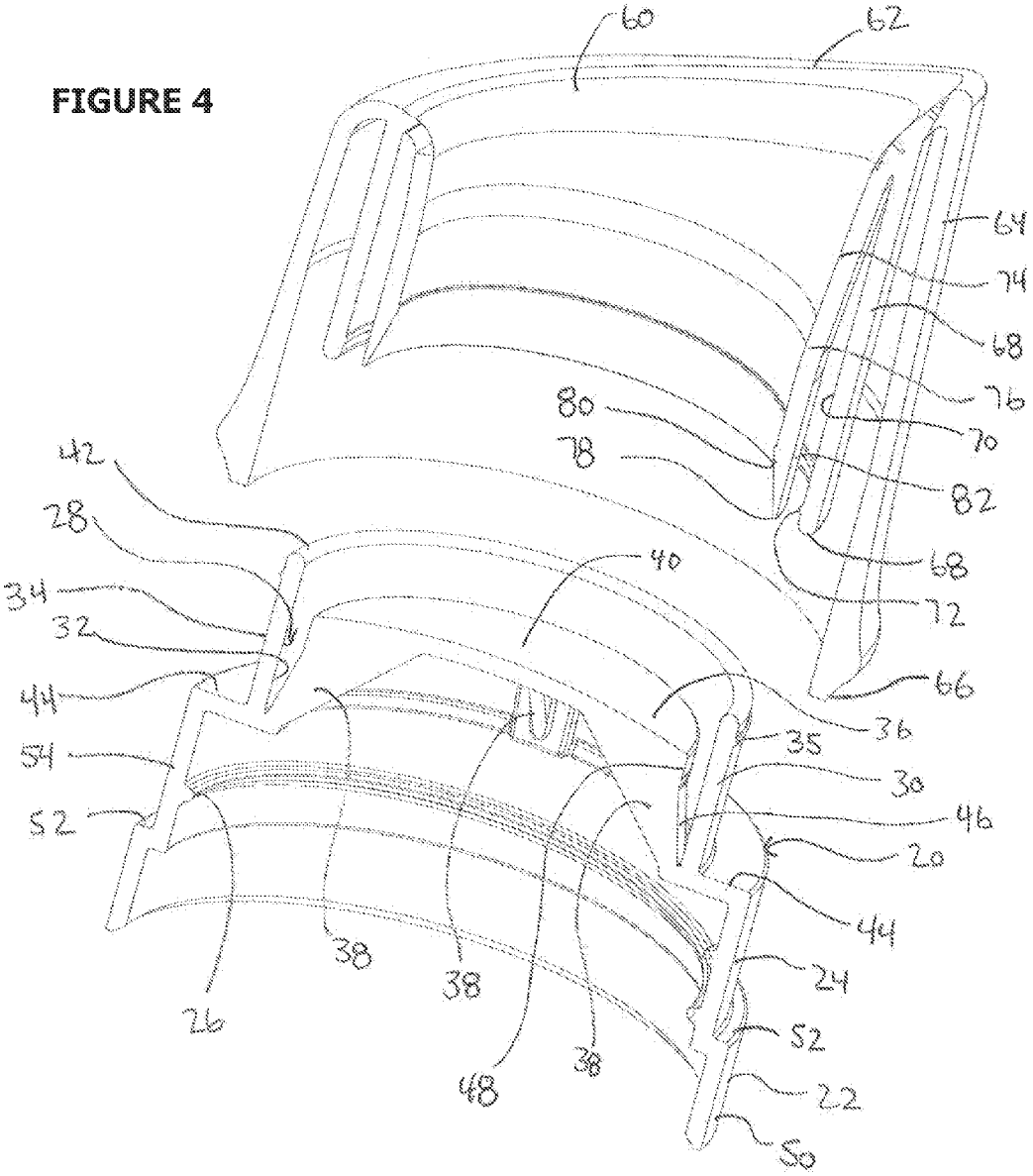
FIG. 4 is a cross sectional exploded view of a closure in accordance with an embodiment of the present invention.
Figure 5:
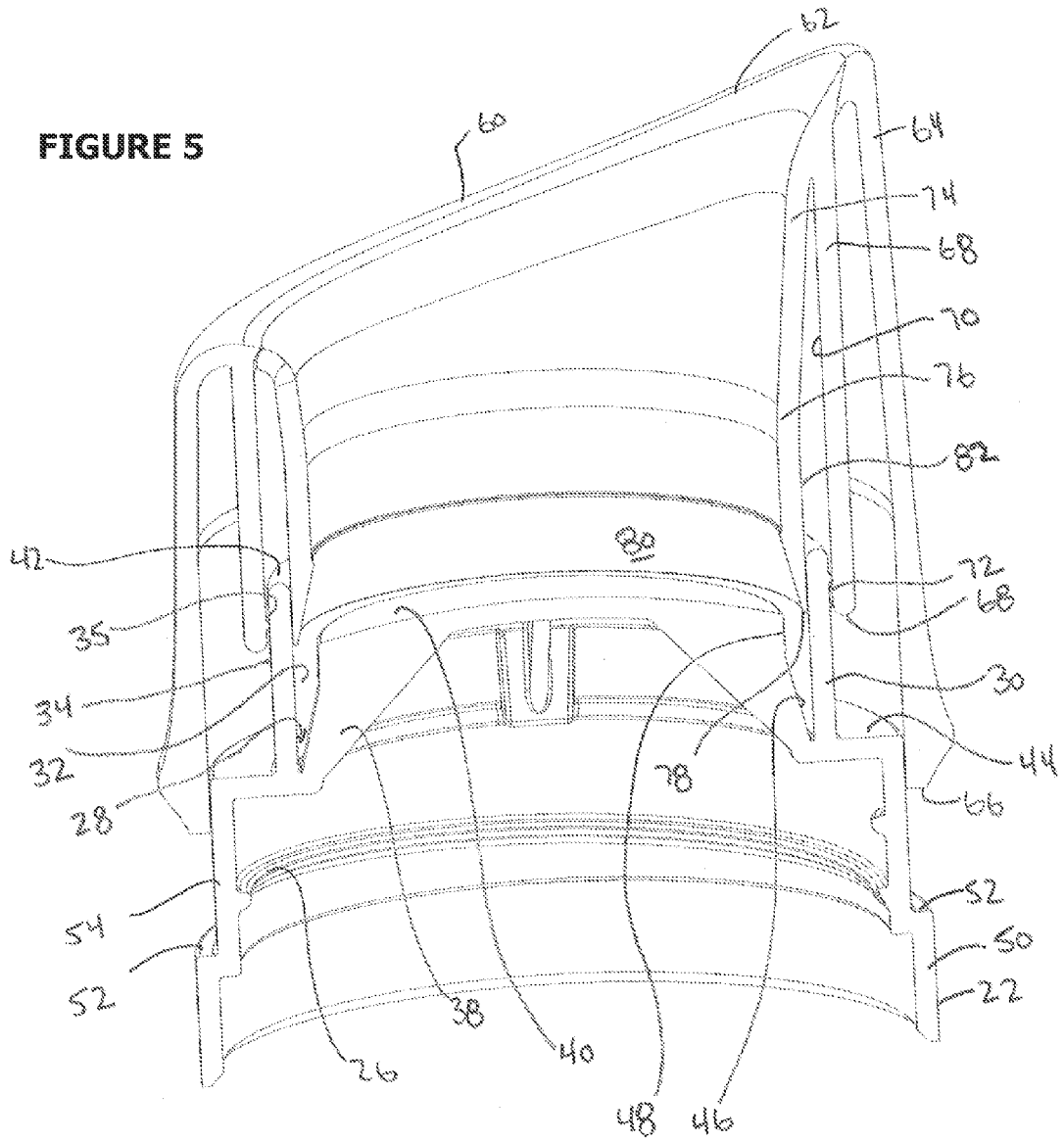
FIG. 5 is a cross sectional view of a closure in accordance with an embodiment of the present invention illustrated in an opened position.
Figure 6:
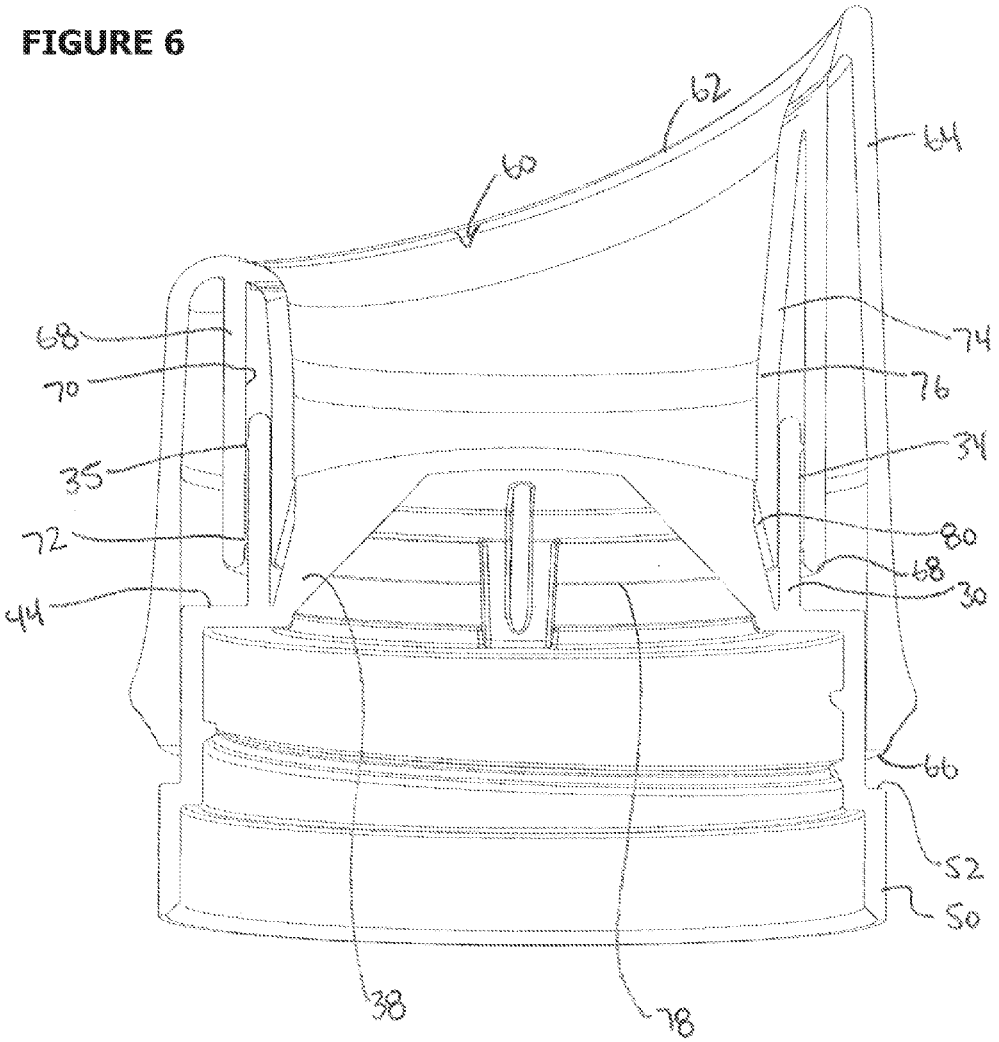
FIG. 6 is a cross sectional view of a closure in accordance with an embodiment of the present invention illustrated in an slightly opened position.
Figure 7:
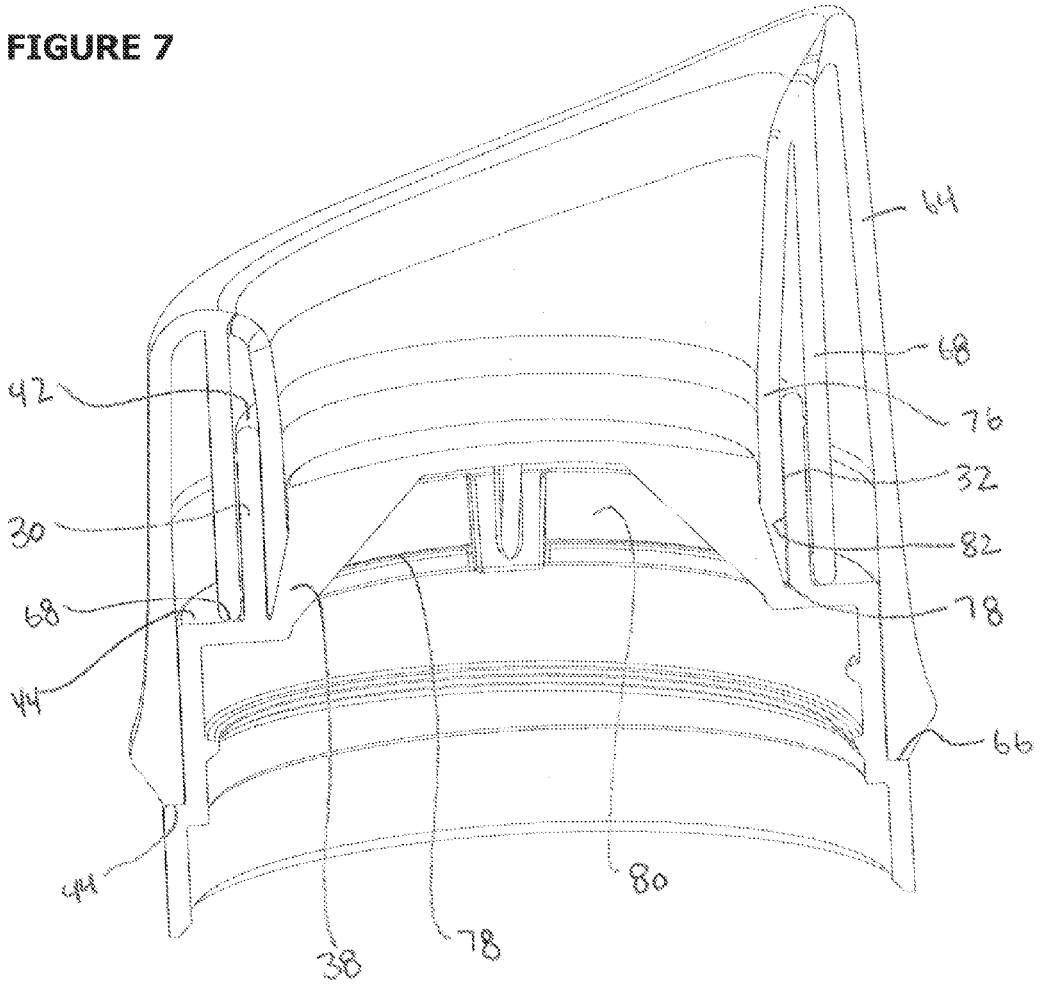
FIG. 7 is a cross sectional view of a closure in accordance with an embodiment of the present invention illustrated in an closed position.
Figure 8:
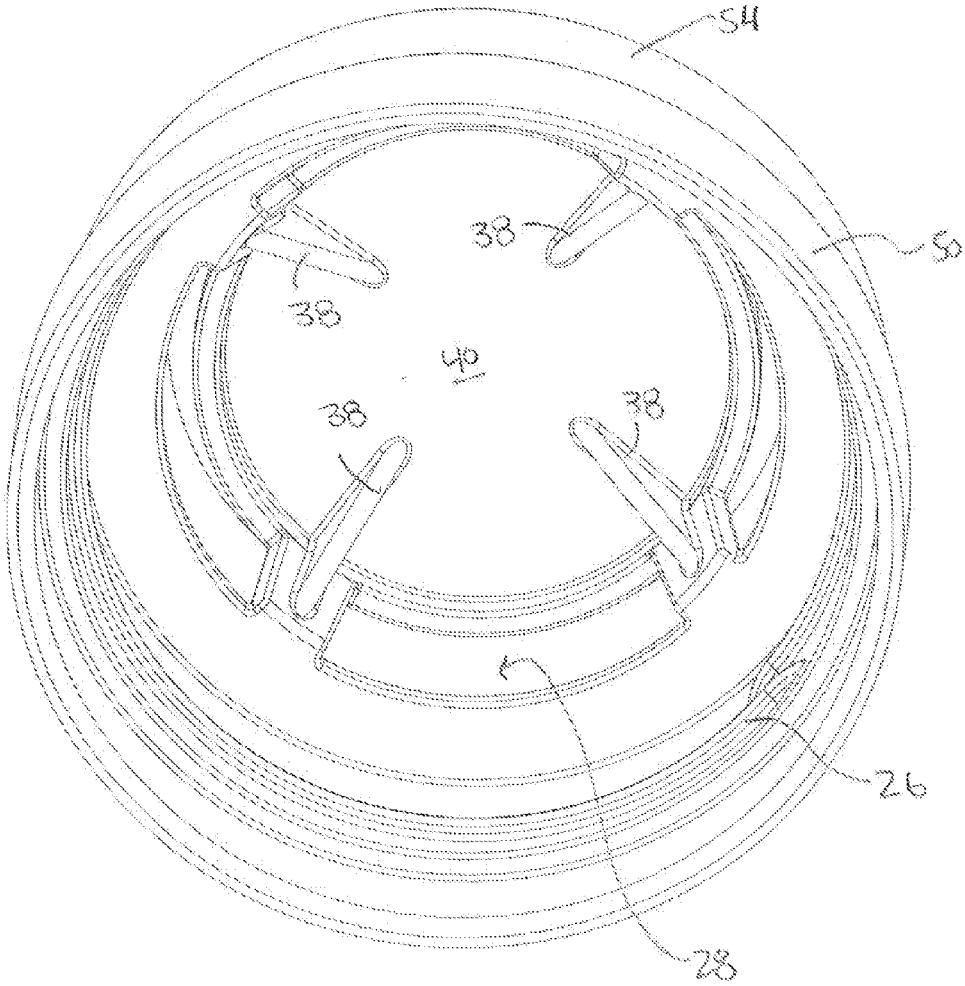
FIG. 8 is a perspective view of the closure in accordance with an embodiment of the present invention illustrated from an underside view.

Referring now to FIGS. 1-8, there is provided a push-pull closure 10 embodying the present invention. The closure 10 includes a shell 20 adapted to attach to the opening of a container, as by a cap portion 22 having an outer cylindrical wall 24 with an inner thread 26 adapted to mate with a threaded portion on a container.

The shell 20 has a central opening 28 surrounded by an annual body 30 defining generally cylindrical inner and outer walls or surfaces 32 and 34, respectively. A stem 36 is suspended within the central opening 28 and attached to the annular body 30 by radial ribs 38 that extend from the annual body 30 to a stem top 40 defined by the stem 36. A flow path is defined around the radial ribs 38 through the central opening 28 and thus fluid may travel between the annual body 30 and the stem 40. The annual body 30 extends from a mid-ledge 44 to an upper terminal edge 42 that extends to a height above the stem top 40. In addition, the radial ribs 38 include an outside surface 46 that tapers inwardly from the mid-ledge 44, which are where the radial ribs 38 are secured to the annual body 30, to a section 48 of the stem top 40.

In addition to the above, outer cylindrical wall 24 is defined to include a lower portion 50 that extends downwardly from a lower ledge 52 and a mid-portion 54 that extends from the lower ledge 52 to the mid-ledge 44. As noted above, extending form the mid-ledge is the annual body 30.

A push-pull cap 60 includes a pouring edge 62 that is defined to have a slightly higher end 64 on one side of the cap than the other side. However, the pouring edge 62 may be uniformly defined around the cap.

Extending from the pouring edge 62 is an outer skirt 64 terminating to an outer skirt end 66. A portion of the outer skirt 64 rides against the mid-portion 54 of the cylindrical wall 24, with the outer skirt end 66 making contact with the lower ledge 52 when the push-pull cap 60 is in a closed position. The pouring edge 62 also includes a middle skirt 68 terminating to a middle skirt end 68. The inside surface 70 of the middle skirt 68 rides against the outside surface 34 of the annual body 30, with the middle skirt end 68 making contact with the mid-ledge 44 when the push pull cap 60 is in a closed position. Lastly, the pouring edge 62 further includes an inner skirt 74 extending downwardly and radially inwardly slightly to a point 76 to clear the middle skirt 68 and then extending downwardly from the point 76 to terminate to an inner skirt end 78. A lower section 80 of the inner skirt towards the inner skirt end 78 tapers back towards an outer surface 82 of the inner skirt 74. This tapered lower section 80 is configured to cooperate and seal against the outside surface 46 of the radial ribs 38 while the outer surface 82 seals against the inner surface 32 of the annual body 30 when the cap 60 is in the closed position. As such, when in the closed position the cap 60 seals the central opening 28 below the stem 40.

An inwardly extending lip 72 is provided around the inside surface 70 of the middle skirt 68 while an outwardly extending lip 35 is provided around the outside surface 34 of the annual body 30. These lips 72 and 35 are generally cylindrical or ring shaped and define surfaces which extend radially in a direction generally transverse to the axial direction. Once assembled, the lips 72 and 35 will cooperate to retain the cap 60 on the shell 20, with the lips engaging when the cap 60 is pulled to its limit of travel. That is the lips which are generally ring shaped with inner and outer diameters, have an interference overlap, with the annular body outwardly extending having an outer diameter greater than the inner diameter of the inwardly extending lip.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

I claim:

1. A push-pull closure comprising:

a shell having a cylindrical wall interiorly configured to attach on one end to a container opening, and further including:

an annual body surrounding a central opening in fluid communication with the container opening when attached thereto, a stem suspended within the central opening, the stem having radial ribs extending from the annual body to a top portion of the stem to define a generally cylindrical fluid path between an inner surface of the annual body and the stem, and wherein the radial ribs include an outside radial rib surface tapering downwardly and outwardly from the stem to the annual body; and a cap having a pouring edge, and further including:

an outer skirt extending from the pouring edge wherein a portion of the outer skirt rides exteriorly against a section of the cylindrical wall, a middle skirt extending from the pouring edge and being interior to the outer skirt, and wherein a portion of the middle skirt rides against an outside surface of the annual body, an inner skirt extending from the pouring edge and being interior to the middle skirt, the inner skirt terminating at an inner skirt end, the inner skirt further having a lower section positioned about the inner skirt end, and wherein the lower section is configured to cooperate and seal against the stem, against the outside radial rib surface, and against the inside surface of the annual body when the cap is in the closed position.

2. The closure of claim 1, wherein the shell further includes an inner thread adapted to mate with a container.

3. The closure of claim 1, wherein the radial ribs comprise four radial ribs equally spaced around the central opening.

4. The closure of claim 1, wherein the shell includes the cylindrical wall defining (a) a lower portion that extends downwardly from a lower ledge, (b) a mid-portion extending from the lower ledge to a mid-ledge, and further defining (c) the annual body extending from the mid-ledge to an upper terminal edge.

5. The closure of claim 4, wherein the outer skirt terminates at an outer skirt end and wherein a portion of the outer skirt rides against the mid-portion of the cylindrical wall with the outer skirt end making contact with the lower ledge when the cap is in a closed position, and wherein the middle skirt terminates at a middle skirt end, with the middle skirt end making contact with the mid-ledge when the cap is in a closed position, and wherein a portion of the inner skirt rides against an inside surface of the annual body.

6. The closure of claim 4, wherein the upper terminal edge extends to a position above the stem.

7. The closure of claim 1, wherein the pouring edge is inclined from one end to another end.

8. The closure of claim 1, wherein the inner skirt extends downwardly from the pouring edge radially inwardly slightly to a first position and then extends downwardly from the first position to the lower section, the lower section tapering radially outwardly to the inner skirt end to define the lower section profile and wherein the lower section profile is configured to cooperate and seal against the stem, against the outside radial rib surface, and against the inside surface of the annual body when the cap is in the closed position.

9. The closure of claim 1, wherein an inside surface of the middle skirt further comprising an inwardly extending lip, and wherein an outside surface of the annual body further comprising an outwardly extending lip and wherein the inwardly extending lip and outwardly extending lip cooperate to retain the cap on the shell when the cap is extending in a fully opened position.

10. A push-pull closure comprising:

a shell configured to attach on one end to a container opening, and further including:

an annual body surrounding a central opening in fluid communication with the container opening when attached thereto, wherein the shell includes a cylindrical wall defining (a) a lower portion that extends downwardly from a lower ledge, (b) a mid-portion extending from the lower ledge to a mid-ledge, and further defining (c) the annual body extending from the mid-ledge to an upper terminal edge, a stem suspended within the central opening, the stem having radial ribs extending from the annual body to a top portion of the stem to define a generally cylindrical fluid path between an inner surface of the annual body and the stem, and wherein the radial ribs include an outside radial rib surface tapering downwardly and outwardly from the stem to the annual body; and a cap having a pouring edge, and further including:

an outer skirt extending from the pouring edge and terminating at an outer skirt end, and wherein a portion of the outer skirt rides against the mid-portion of the cylindrical wall with the outer skirt end making contact with the lower ledge when the cap is in a closed position, a middle skirt extending from the pouring edge and being interior to the outer skirt, the middle skirt terminating at a middle skirt end, and wherein a portion of the middle skirt rides against an outside surface of the annual body with the middle skirt end making contact with the mid-ledge when the cap is in a closed position, an inner skirt extending from the pouring edge and being interior to the middle skirt, the inner skirt terminating at an inner skirt end, the inner skirt further having a lower section positioned about the inner skirt end, and wherein the lower section is configured to cooperate and seal against the stem, against the outside radial rib surface, and against the inside surface of the annual body when the cap is in the closed position.

11. The closure of claim 10, wherein the radial ribs comprise four radial ribs equally spaced around the central opening.

12. The closure of claim 10, wherein the upper terminal edge extends to a position above the stem.

13. The closure of claim 10, wherein the pouring edge is inclined from one end to another end.

14. The closure of claim 10, wherein the inner skirt extends downwardly from the pouring edge radially inwardly slightly to a first position and then extends downwardly from the first position to the lower section, the lower section tapering radially outwardly to the inner skirt end to define the lower section profile and wherein the lower section profile is configured to cooperate and seal against the stem, against the outside radial rib surface, and against the inside surface of the annual body when the cap is in the closed position.

15. The closure of claim 10, wherein an inside surface of the middle skirt further comprising an inwardly extending lip, and wherein an outside surface of the annual body further comprising an outwardly extending lip and wherein the inwardly extending lip and outwardly extending lip cooperate to retain the cap on the shell when the cap is extending in a fully opened position.

* * * * *